United States Patent [19]

Kurashima

[11] Patent Number: 4,528,726

[45] Date of Patent: Jul. 16, 1985

[54] CUFF LINK

[76] Inventor: Hideo Kurashima, 5-12, Negishi 1-chome, Taito-ku, Tokyo, Japan

[21] Appl. No.: 541,161

[22] Filed: Oct. 12, 1983

[51] Int. Cl.[3] ..... A41B 7/04; A44B 5/00

[52] U.S. Cl. ..... 24/41; 24/43; 24/48; 24/97

[58] Field of Search ..... 24/41, 43, 48, 97, 453, 24/676

[56] References Cited

U.S. PATENT DOCUMENTS

| | | | |
|---|---|---|---|
| 752,587 | 2/1904 | Pitts | 24/41 |
| 922,476 | 5/1909 | Henderson | 24/41 |
| 1,199,422 | 9/1916 | Reitzel | 24/676 |
| 1,586,572 | 6/1926 | Morton . | |
| 2,520,886 | 8/1950 | Marien | 24/97 |
| 2,585,181 | 2/1952 | Stavropoulos et al. | 24/97 |
| 2,688,785 | 9/1954 | Carpinella . | |
| 2,786,251 | 3/1957 | Van Buren . | |
| 3,556,104 | 1/1971 | Janklow | 24/543 |
| 4,242,776 | 1/1981 | Kurashima . | |
| 4,361,936 | 12/1982 | Kurashima . | |

FOREIGN PATENT DOCUMENTS

| | | |
|---|---|---|
| 5040262 | 10/1978 | Japan . |
| 50163503 | 10/1978 | Japan . |
| 50169845 | 10/1978 | Japan . |
| 53-3857 | 10/1978 | Japan . |

*Primary Examiner*—Victor N. Sakran

*Attorney, Agent, or Firm*—Cushman, Darby & Cushman

[57] ABSTRACT

A cuff link removably attachable to a shirt cuff which has one buttonhole only comprises a link member detachably mountable on one cuff end in resiliently clamping relationship and a decorative member removably attachable to the link member on the other cuff. The link member includes a link post having a semispherical head insertable through the buttonhole in the other cuff into a circular hole in the decorative member and retainable therein by a spring fitted in grooves in the head. The decorative member can be attached to the link member simply by pushing them together until the spring is fitted in the grooves. For detaching the decorative member from the link member, they are relatively turned until the spring is displaced out of the grooves, whereupon the head can be pushed out of the circular hole under the resiliency of the spring.

2 Claims, 20 Drawing Figures

CUFF LINK

BACKGROUND OF THE INVENTION

1. Field of the Invention

The present invention relates to a cuff link, and more particularly to a cuff link for use on a single cuff of a shirt.

2. Description of the Prior Art

As is well known, shirts for men's use are largely classified into two types; those with single cuffs and those with double cuffs. Cuff links are normally used with the double cuffs to fasten cuff ends and also to provide an ornamental effect, and are one of few decorative pieces worn by men. There has been proposed a cuff link having a high ornamental effect for use with single cuffs. The proposed cuff links include a link member having a shank to be inserted through buttonholes in cuff ends of a shirt and a decorative box member removably attachable to the link member and having an inner recess for receiving and concealing a button on the shirt cuff.

Commercially available cuff links can be used, without any substantial structural modification, on single-cuff shirts having button holes in both cuff ends.

There are single-cuff shirts available on the market which have a button hole in one cuff end and no buttonhole in the other cuff end. Cuff links of the prior construction cannot be used on such shirts.

The inventor has filed a U.S. patent application Ser. No. 495,126 on May 16, 1983, directed to a cuff link.

SUMMARY OF THE INVENTION

Accordingly, it is an object of the present invention to provide a cuff link which can be used on a single-cuff shirt having a buttonhole in one cuff end only.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
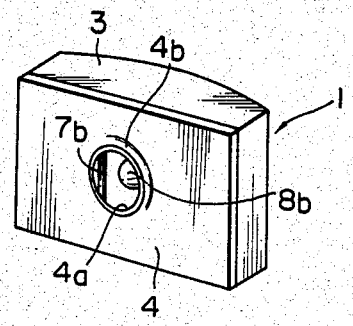
FIG. 1 is a perspective view of a decorative member of a cuff link according to the present invention.
Figure 2:
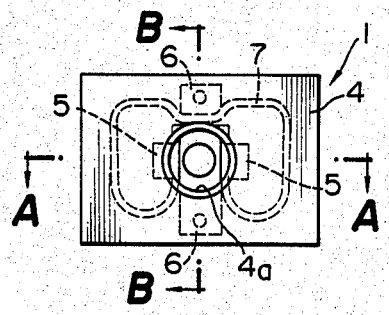
FIG. 2 is a rear elevational view of the decorative member.
Figure 3:
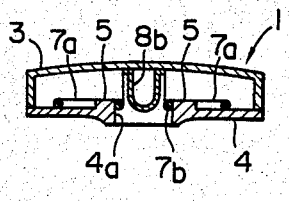
FIG. 3 is a cross-sectional view taken along line A—A of FIG. 2.

As shown in FIGS. 1 through 3, a cuff link according to the present invention includes a decorative member 1 substantially in the form of a rectangular parallel piped or box. The cuff link also has a separate link member 2 (FIG. 10) detachably attachable to the decorative member 1.

Figure 6:
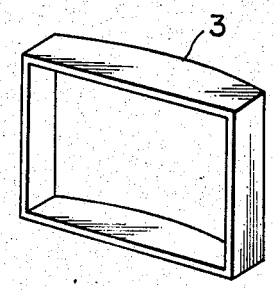
FIG. 6 is a perspective view of a box body of the decorative member.

The decorative member 1 is composed of a box body 3 (FIG. 6) of precious metal having one side open and a suitable ornamental design on the opposite side, and a rectangular side plate 4 brazed or otherwise attached to the open side of the box body 3. The side plate 4 has a central circular hole **4*a* with an annular boss 4*b* surrounding the circular hole 4*a* and having a progressively raised surface leading to the circular hole 4*a*. The side plate 4 also has a pair of lateral projections 5, 5 (FIGS. 2 and 3) on an inner surface thereof which are disposed in diametrically opposite relation to each other across the circular hole 4*a* in the longitudinal direction of the side plate 4 and located adjacent to the circular hole 4*a*. Each of the projections 5, 5 is rectangular in shape and is spaced from the circular hole 4*a*** so as to create a gap large enough to accommodate a spring (described later on).

Figure 5:
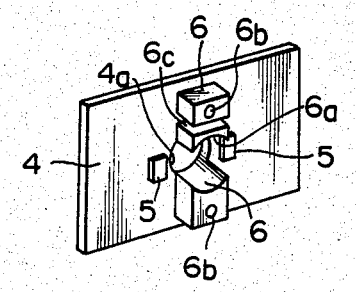
FIG. 5 is a perspective view of a side plate of the decorative member.
Figure 4:
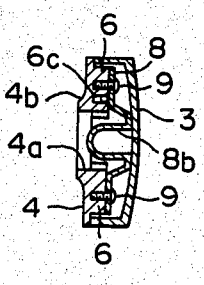
FIG. 4 is a cross-sectional view taken along line B—B of FIG. 2.

As shown in FIGS. 4 and 5, the side plate 4 has on the inner surface a pair of upper and lower diametrically opposite projections 6, 6 spaced transversely of the side plate 4 across the circular hole **4*a*. The projections 6, 6 have inner curved surfaces 6*a*, 6*a* having a radius of curvature equal to the of the circumferential edge of the circular hole 4*a* and lying flush therewith, and have widths smaller than the diameter of the circular hole 4*a*. The projections 6, 6 have small-diameter screw holes 6*b*, 6*b*, respectively. The upper projection 6 has a transverse slot 6*c* extending longitudinally of the side plate 4 and deep enough to reach the inner surface of the side plate 4. The slot 6*c*** has a width which is substantially the same as the diameter of the steel wire of the spring.

Figure 7:
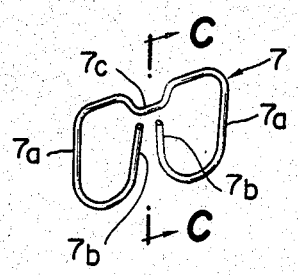
FIG. 7 is a perspective view of a spring of the decorative member.
Figure 8:
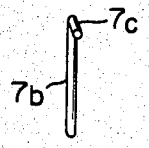
FIG. 8 is a cross-sectional view taken along line C—C of FIG. 7.

FIG. 7 shows a spring 7 incorporated in the decorative member 1. The spring 7 is made of steel wire and has symmetrical configuration somewhat similar to the front frame of a pair of eyeglasses. The spring 7 includes a pair of substantially U-shaped frame portions **7*a*, 7*a* having straight inner free ends 7*b*, 7*b* bent inwardly and joined together by an upper central stepped portion 7*c* displaced toward the free ends 7*b*, 7*b* and having a length which is substantially the same as the width of the upper projection 6. The stepped portion 7*c* is fitted in the slot 6*c* in the upper projection 6. As illustrated in FIG. 8, the stepped portion 7*c*** is inclined outwardly with respect to the free ends 7*b*, 7*b*. Thus, the stepped portion 7*c* lies in a plane which is not parallel to, but crosses the plane in which the frame portions 7*a*, 7*b* lie.

Figure 14:
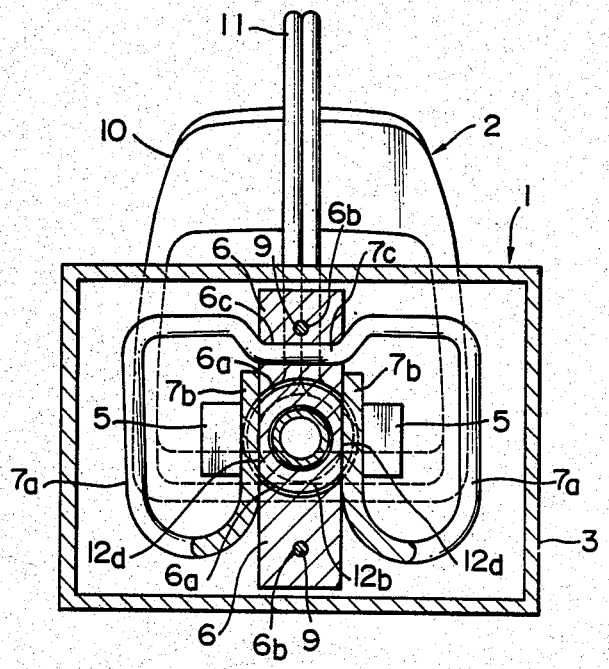

As shown in FIGS. 2 and 14, with the stepped portion 7*c* of the spring 7 being fitted in the slot 6*c* in the upper projection 6, the projections 5, 5 are positioned in the frame portions 7*a*, 7*b*, respectively, and the free ends 7*b*, 7*b* are disposed between the projections 5 and 6 with the free ends 7*b*, 7*b* having distal ends located one on each side of the upper projection 6 below the slot 6*c* therein. The free ends 7*b*, 7*b* are partly positioned in the circular hole 4*a* while resiliently clamping the lower end portion of the upper projection 6.

Figure 9:
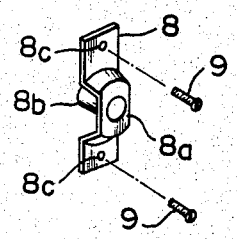
FIG. 9 is a perspective view of a locking member of the decorative member.

After the spring 7 has been attached to the side plate 4, a locking member 8 (FIG. 9) is attached to the inner surface of the side plate 4. The locking member 8 is substantially rectangular in profile and has a protrusion 8*a* of a partly circular shape at a longitudinally central position thereof, the protrusion 8*a* projecting toward the box body 3. The protrusion 8*a* includes a cylindrical portion 8*b* extending toward the side plate 4 and having a rounded distal end of an arcuate cross section. The protrusion 8*a* has a proximal end having a diameter which is substantailly the same as that of the circular hole 4*a*. The cylindrical portion 8*b* has a central axis aligned with the central axis of the circular hole 4*a*.

The locking member 8 has a length equal to the distance between the lower and upper ends of the projections 6, 6 and has a width identical to that of the projections 6, 6. For attaching the locking member 8, screws 9, 9 are inserted through holes 8*c*, 8*c*, respectively, in upper and lower ends of the locking member 8, and then threaded respectively into the screw holes 6*b*, 6*b* in the projections 6, 6. With the locking member 8 fastened, the rounded distal end of the cylindrical portion 8*b* is positioned centrally in the circular hole 4*a* in coaxial relationship as illustrated in FIG. 4.

Figure 10:
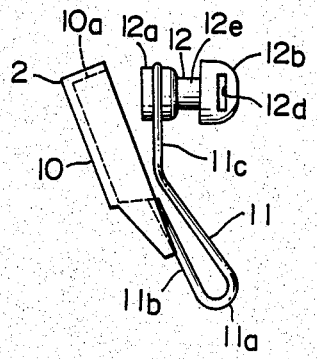
FIG. 10 is a side elevational view of a link member.
Figure 11:
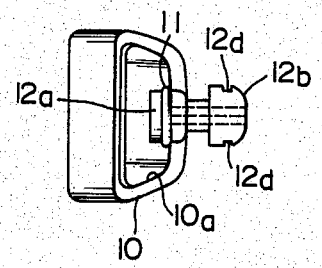
FIG. 11 is a plan view of the link member.

As shown in FIGS. 10 and 11, the link member 2 is composed of a button shield 10 having a recess 10*a* therein for receiving a button, and a link arm 11 of a substantially U-shaped bent configuration attached to an end of the button shield 10 in overhanging relationship thereto. The button shield 10 is shown as being substantially rectangular in shape, but may be of any desired shape.

The link arm 11 is made by folding a single steel wire on itself and includes a U-shaped bent portion 11*a* having an end 11*b* affixed to the button shield 10 and a free end 11*c* extending over the recess 10*a* in the button shield 10, there being a link post 12 secured to a distal end of the free end 11*c*. The link post 12 has a proximal end 12*a* around which the free end 11*c* of the link arm 11 is firmly wound, and a semispherical head 12*b* on a distal end thereof. The head 12*b* has a hole 12*c* for insertion therein of the cylindrical portion 8*b* of the locking member 8. The head 12 also has lateral grooves 12*d* defined in side surfaces thereof in diametrically opposite relationship across the axis of the link post 12 for fitting engagement with the free ends 7*b*, 7*b* of the spring 7. The grooves 12*d* have a width and depth large enough to receive the free ends 7*b*, respectively, of the spring 7. The proximal end 12*a* and the head 12*b* are coupled by a smaller-diameter shank 12*e* having a length slightly larger than the thickness of fabric of a shirt to which the cuff link of the invention is to be attached.

As shown in FIG. 10, the U-shaped portion 11*a* of the link arm 11 defines a progressively narrower opening, and the free end 11*c* thereof is bent so that its distal end is oriented progressively away from the button shield 10.

The manner in which the cuff link thus constructed is used will now be described.

Figure 19:
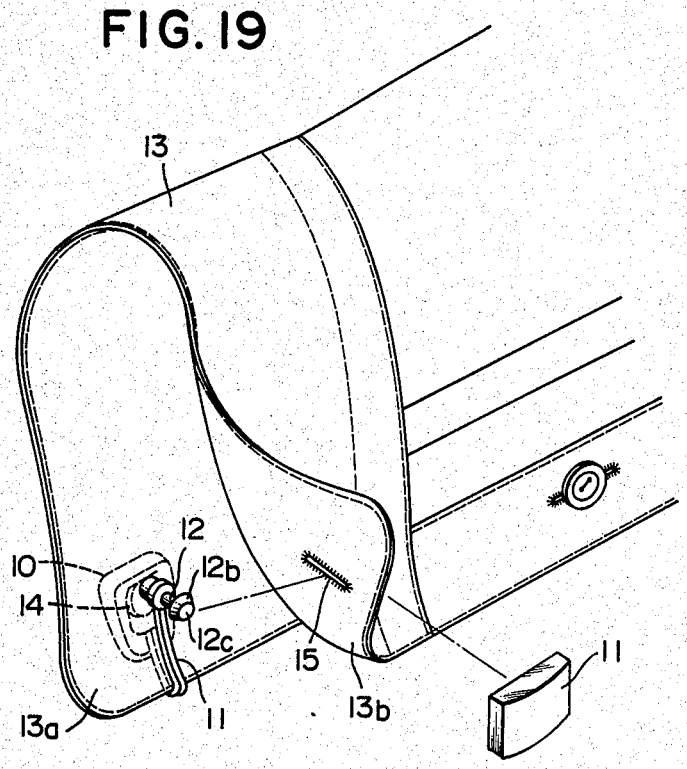
FIG. 19 is a perspective view showing the manner in which the cuff link of the invention is attached to a cuff of a shirt.
Figure 20:
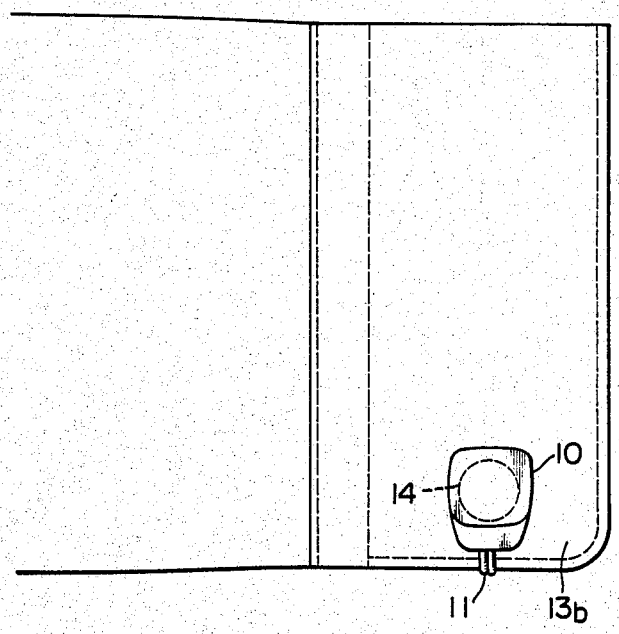
FIG. 20 is a side elevational view of the cuff on which the cuff link is mounted.

After the wearer's hand is inserted into a cuff 13 (FIG. 19), the link member 2 is attached to a cuff end 13*a* which faces the wearer's body. More specifically, the button shield 10 is fitted over a button 14 stitched to the cuff end 13*a* with the button 14 received in the recess 10*a* in the button shield 10, and the link arm 11 clamps the cuff end 13*a* under the resiliency of the U-shaped portion 11*a*. At this time, the link post 12 is directed toward the other cuff end 13*b* of the cuff 13 in substantial alignment with a buttonhole 15 defined in the cuff end 13*b*. The head 12*b* of the link post 12 is now inserted through the buttonhole 15 until it projects out of the cuff end 13*b*. The decorative member 1 is now brought toward the link member 2 until the reverse side of the decorative member 1 faces the exposed head 12*b*, with the decorative member 1 being longitudinally aligned with the axis of the shirt sleeve. At this time, the free ends 7*b*, 7*b* of the spring 7 extend parallel to the grooves 12*b*, 12*b*, respectively, in the head 12*b* of the link post 12.

Figure 12:
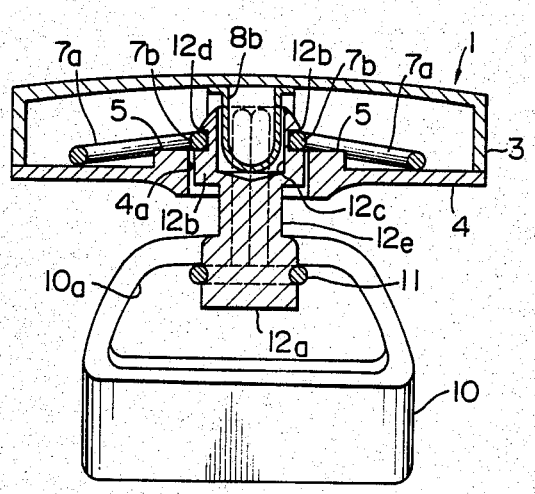
FIG. 12 is a horizontal cross-sectional view of the decorative and link members as they are about to be coupled together.
Figure 13:
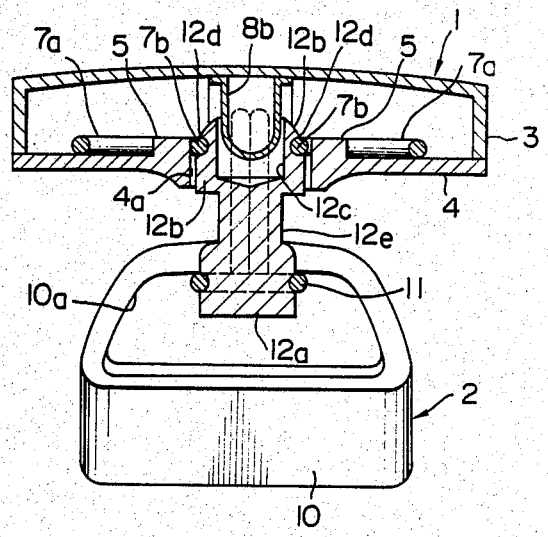
FIGS. 13 and 14 are horizontal and vertical cross-sectional views of the decorative and link members as they are completely coupled together.

The link post 12 is now forced into the circular hole 4*a* in the side plate 4. As shown in FIGS. 12 and 13, the head 12*b* of the link post 12 pushes the free ends 7*b*, 7*b* of the spring 7 inwardly and spread the free ends 7*b*, 7*b* apart laterally while the free ends 7*b*, 7*b* are engaged by the semispherical surface of the head 12*b*, until the free ends 7*b*, 7*b* are snapped into the grooves 12*d*, 12*d*, respectively. When the decorative member 1 is released of a manual push, the link post 12 is slightly pushed back to the position of FIG. 13 under the resilient force of the free ends 7*b*, 7*b* of the spring 7 as they spring back against the inner surface of the side plate 4.

In this position, the link post 2 is prevented from being pulled out of the circular hole 4 since the free ends 7*b*, 7*b* of the spring 7 are fully fitted in the grooves 12*d*, 12*d*, respectively. The link post 2 is also retained reliably in position without being subjected to wobbling movement because of the cylindrical portion 8*b* of the locking member 8 being fitted in the hole 12*c* in the head 12*b*.

Figure 15:
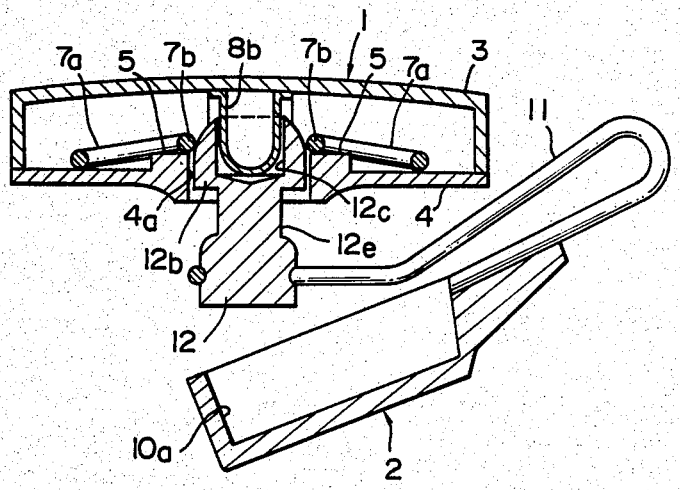
FIGS. 15 and 16 are horizontal and vertical cross-sectional views of the decorative and link members as they are about to be detached from each other.
Figure 16:
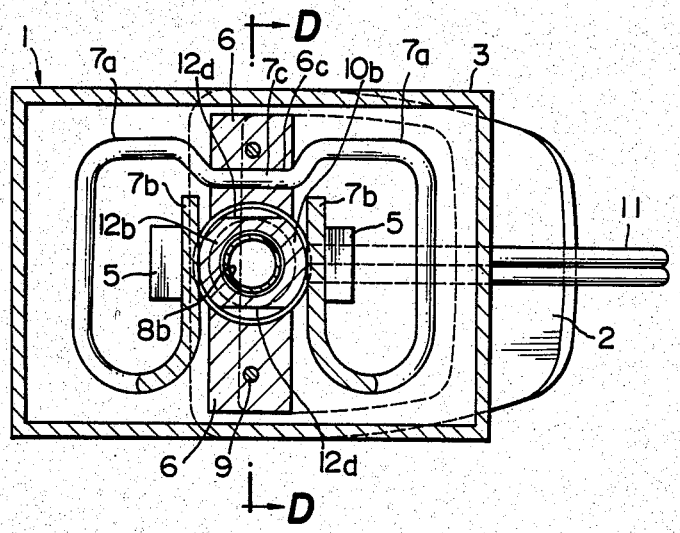
Figure 17:
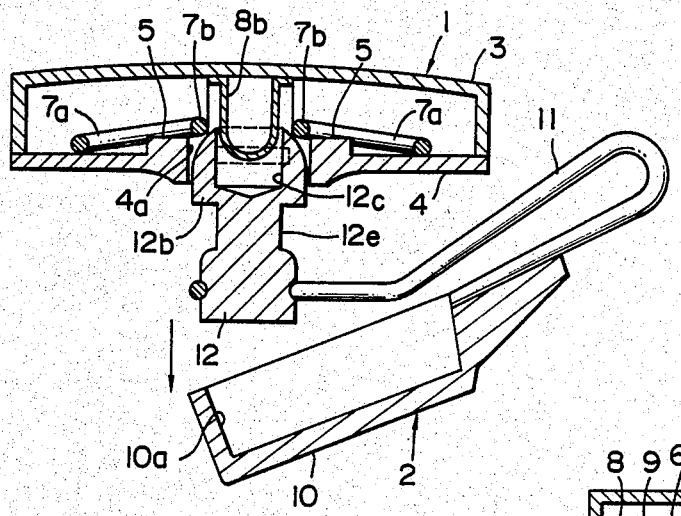
FIG. 17 is a vertical cross-sectional view of the decorative and link members as they are being detached from each other.
Figure 18:
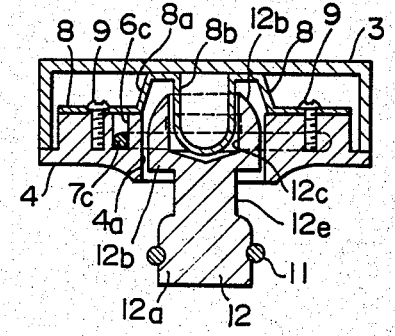
FIG. 18 is a cross-sectional view taken along line D—D of FIG. 16.

When it is desired to detach the cuff link from the shirt cuff, the decorative member 1 is pushed toward the link member 2 as shown in FIG. 15 to force the free ends 7*b*, 7*b* of the spring 7 into the decorative member 1 again to the position of FIG. 13. The decorative member 1 and the link member 2 are now turned through 90° relatively to each other until the free ends 7*b*, 7*b* are displaced out of the grooves 12*d*, 12*d*, respectively, into clamping engagement with round peripheral surfaces of the head 12*b* of the link post 12.

The decorative member 1 is then released of a manual push, and the free ends 7*b*, 7*b* of the spring 7 are resiliently moved back to push out the link post 12 through the circular hole 4*a* while the free ends 7*b*, 7*b* are acting slidably on the cam means which is provided by the semispherical head 12*b*. The decorative member 1 is now separated from the link member 2 and detached from the shirt cuff.

The link post 12 is then removed from the buttonhole 15, the button shield 10 is detached from the button 14, and the link arm 11 is slipped off the cuff end 13*a* by the wearer. Consequently, the link member 2 is completely dismounted from the cuff 13.

The cuff link according to the present invention can therefore be attached to a single-cuff shirt having a button hole in one cuff end only, while at the same time concealing a button attached to the other cuff.

Although a certain preferred embodiment has been shown and described, it should be understood that many changes and modifications may be made therein without departing from the scope of the appended claims.

What is claimed is:

1. A cuff link for removably securing the ends of a single shirt cuff in an instance where one end of the single shirt cuff has a button hole and the other end of the single shirt cuff has a button, said cuff link comprising:

a link member, including:

a button shield including means defining a recess which is open in a direction at one side for receiving and concealing said button;

a link post having a base and a head, said link post being disposed generally in front of and aimed generally in the same direction as that in which said recess opens; and a closed-up generally U-shaped link arm securing said base of said link post to said button shield; and a decorative member said decorative member and said head of said link post icnluding cooperative securement means constructed and arranged for disconnectably securing said decorative member on said head of said link post, so that the two ends of the single shirt cuff may be disconnectably connected by catching an edge of the button-having end of the single shirt cuff in the U-shaped link arm of the link member with the recess of the button shield receiving the button and the button shield hiding the button, inserting the link post, head first, through the button hole, and disconnectably securing the decorative member on said head of said link post; said cooperative securement means including:

means defining a rear opening into said decorative member, a spring mounted within the decorative member so as to have two laterally spaced portions which normally partially obscure said opening; and said head of said link post including two laterally spaced, laterally outwardly open grooves respectively constructed and arranged to snappingly resiliently receive said two laterally spaced portions of said spring only when said decorative member has a preselected angular orientation relative to said link member angularly about said link post, so that the decorative member can be disconnectably secured on said head of said link member by placing said decorative member in said pre-selected angular orientation and pushing said head of said link member into said opening until said two laterally spaced portions of said spring snap into said grooves and said decorative member can be disconnected from said link member by angularly moving said decorative member about said link post until said two laterally spaced portions of said spring are no longer received in said grooves, and withdrawing said decorative member from said link member;

axially directed protrusion and recess means respectively secured within said decorative member and provided on said head of said link post, these being constructed and arranged to interfit when said decorative member is disconnectably connected with said link post;

said spring on said decorative member, and cam means provided on said head of said link post, being constructed and arranged to resiliently axially bias said head of said link post towards expulsion through said opening, so that when said two laterally spaced portions of said spring are in said grooves, said decorative member must be further pressed towards said base of said link post in order to permit said decorative member to be angularly moved, whereupon, after such pressing and angular movment, said head of said link post is expelled through said opening;

said decorative member further including:

a box body with an open side, said box body having longitudinal and transverse directions;

a side plate secured to said box body to close said open side and having means defining a central circular hole therethrough as said rear opening; and a locking member attached to said side plate on means defining a surface of said side plate which faces said box body;

said side plate having on said surface a pair of first projections which are spaced from each other in diametrically opposite relationship to each other across said circular hole in said longitudinal direction;

said first projections having side edges located adjacent to a circumferential edge of said circular hole;

said side plate also having on said surface a pair of said projections which are spaced from each other in diametrically opposite relationship to each other across said circular hole in said transverse direction;

said second projections having curved surfaces respectively lying flush with said circumferential edge of said circular hole;

one of said second projections having a slot therein extending in said longitudinal direction; said decorative member further including:

said spring being made of metal wire and comprising a pair of frame portions, a pair of straight free ends bent inwardly from said frame portions, respectively, and a stepped portion displaced toward said free ends and inclined outwardly into fitting engagement in said slot;

said free ends being disposed between the side edges of said first projections and having distal ends held in contact with the side edges of said projection having said slot;

said locking member being fixed to said second projections and having a cylindrical portion disposed centrally in said circular hole in coaxial relationship; said link member including:

said link post head being semispherical and having a hole defined in a distal end thereof in coaxial relationship to said link post respectively to provide said cam means and said axially directed recess means; and said pair of grooves being defined in diametrically opposite relationship in a peripheral surface of the head and extending normally to an axis of said link post;

said free ends of said spring being fittingly receivable in said grooves, respectively; and said link arm having a bent portion which is resilient in a direction to clamp an end of a cuff of a shirt to which the cuff link is to be attached.

2. A cuff link, comprising:

a decorative member; and a link member removably attachable to said decorative member;

said decorative member including:

a box body with an open side, said box body having longitudinal and transverse directions;

a side plate secured to said box body to close said open side and having means defining a central circular hole therethrough; and a locking member attached to said side plate on means defining a surface of said side plate which faces said box body;

said side plate having on said surface a pair of first projections which are spaced from each other in diametrically opposite relationship to each other across said circular hole in said longitudinal direction;

said first projections having side edges located adjacent to a circumferential edge of said circular hole;

said side plate also having on said surface a pair of second projections which are spaced from each other in diametrically opposite relationship to each other across said circular hole in said transverse direction;

said second projections having curved surfaces respectively lying flush with said circumferential edge of said circular hole;

one of said second projections having a slot therein extending in said longitudinal direction; said decorative member further including:

a spring of metal wire comprising a pair of frame portions, a pair of straight free ends bent inwardly from said frame portions, respectively, and a stepped portion displaced toward said free ends and inclined outwardly into fitting engagement in said slot;

said free ends being disposed between the side edges of said first projections and having distal ends held in contact with the side edges of said projection having said slot;

said locking member being fixed to said second projections and having a cylindrical portion disposed centrally in said circular hole in coaxial relationship; said link member including:

a button shield having a recess;

a resilient U-shaped link arm extending from said button shield toward said recess; and a link post fixed to a distal end of said link arm;

said link post having on a distal end thereof a semi-spherical head having a hole defined in a distal end thereof in coaxial relationship to said link post; and a pair of grooves defined in diametrically opposite relationship in a peripheral surface of the head and extending normally to an axis of said link post;

said free ends of said spring being fittingly receivable in said grooves, respectively; and said link arm having a bent portion which is resilient in a direction to clamp an end of a cuff of a shirt to which the cuff link is to be attached.

* * * * *